US005810622A

United States Patent [19]

Chang

[11] Patent Number: 5,810,622

[45] Date of Patent: Sep. 22, 1998

[54] SAFETY ELECTRIC ADAPTER

[76] Inventor: Chi Hsiung Chang, P.O. Box 82-144, Taipei, Taiwan

[21] Appl. No.: 829,070

[22] Filed: Mar. 31, 1997

[51] Int. Cl.[6] ..... H01R 13/68

[52] U.S. Cl. ..... 439/622; 439/954

[58] Field of Search ..... 439/621, 622, 439/490, 954; 337/198

[56] References Cited

U.S. PATENT DOCUMENTS

| | | | |
|---|---|---|---|
| 5,281,943 | 1/1994 | Liao | 337/198 |
| 5,320,563 | 6/1994 | Liao | 439/910 X |
| 5,451,173 | 9/1995 | Mai | 439/622 |
| 5,605,466 | 2/1997 | Devlin et al. | 439/954 X |

*Primary Examiner*—Khiem Nguyen

*Attorney, Agent, or Firm*—A & J

[57] ABSTRACT

A safety electric adapter includes an electrically insulative housing having a first straight side wall and a second straight side wall met at one end and defining a 74-degree contained angle, and an arched side wall connected between the first and second straight side walls, a first metal blade and a second metal blade respectively mounted in the housing and having a respective front plug end respectively extended out of a respective blade slot at the first straight side wall of the housing and adapted for mounting in a power supply outlet and a respective forked receiving tail respectively disposed in alignment with a respective plug hole at the second straight side wall of the housing for receiving an electric plug, and a thermo-fuse and an overcurrent protective fuse connected in series between the front plug end and forked receiving tail of the first metal blade.

3 Claims, 3 Drawing Sheets

SAFETY ELECTRIC ADAPTER

BACKGROUND OF THE INVENTION

1. Field of the Invention

This invention relates to an electric adapter adapted for mounting in a power supply outlet for receiving an electric plug of an electric appliance, and more particularly to a safety electric adapter which automatically breaks the circuit in case of an overload.

2. Description of the Prior Art

An electric appliance generally has an electric plug adapted for connecting to a power supply outlet. The electric plugs of regular electric appliances are commonly not safe in use because they cannot automatically break the circuit in case of an overload.

SUMMARY OF THE INVENTION

This invention relates to an electric adapter adapted for mounting in a power supply outlet for receiving an electric plug of an electric appliance, and more particularly to a safety electric adapter which automatically breaks the circuit in case of an overload.

According to one aspect of the present invention, the safety electric adapter comprises an electrically insulative housing having a first straight side wall and a second straight side wall met at one end, and an arched side wall connected between the first and second straight side walls, a first metal blade and a second metal blade respectively mounted in the housing and having a respective front plug end respectively extended out of a respective blade slot at the first straight side wall of the housing and adapted for mounting in a power supply outlet and a respective forked receiving tail respectively disposed in alignment with a respective plug hole at the second straight side wall of the housing for receiving an electric plug, and a thermo-fuse and an overcurrent protective fuse connected in series between the front plug end and forked receiving tail of the first metal blade. According to another aspect of the present invention, the first straight side wall and second straight side wall of the housing define a contained angle about 74 degrees such that the second straight side wall tilts upwards from the horizontal at about 16-degree angle when the first straight side wall is coincided with the vertical, and the electric plug which is connected to the plug holes at the second straight side wall is forced by the gravity weight of its electric wire to become firmly retained to the electric adapter.

DETAILED DESCRIPTION OF THE PREFERRED EMBODIMENT

Figure 1:
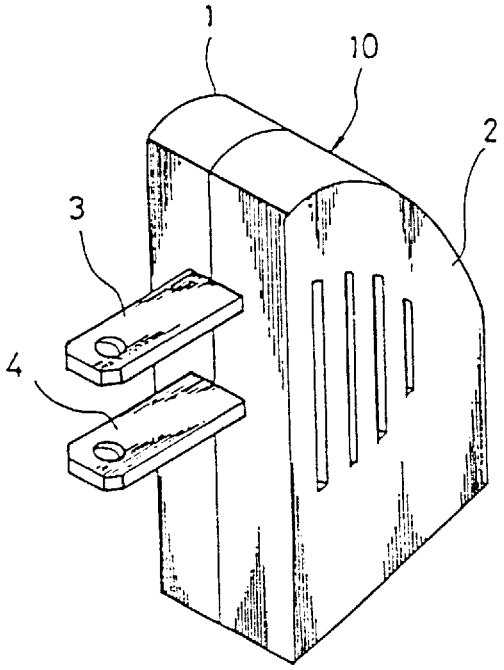
FIG. 1 is an elevational view of a safety electric adapter according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
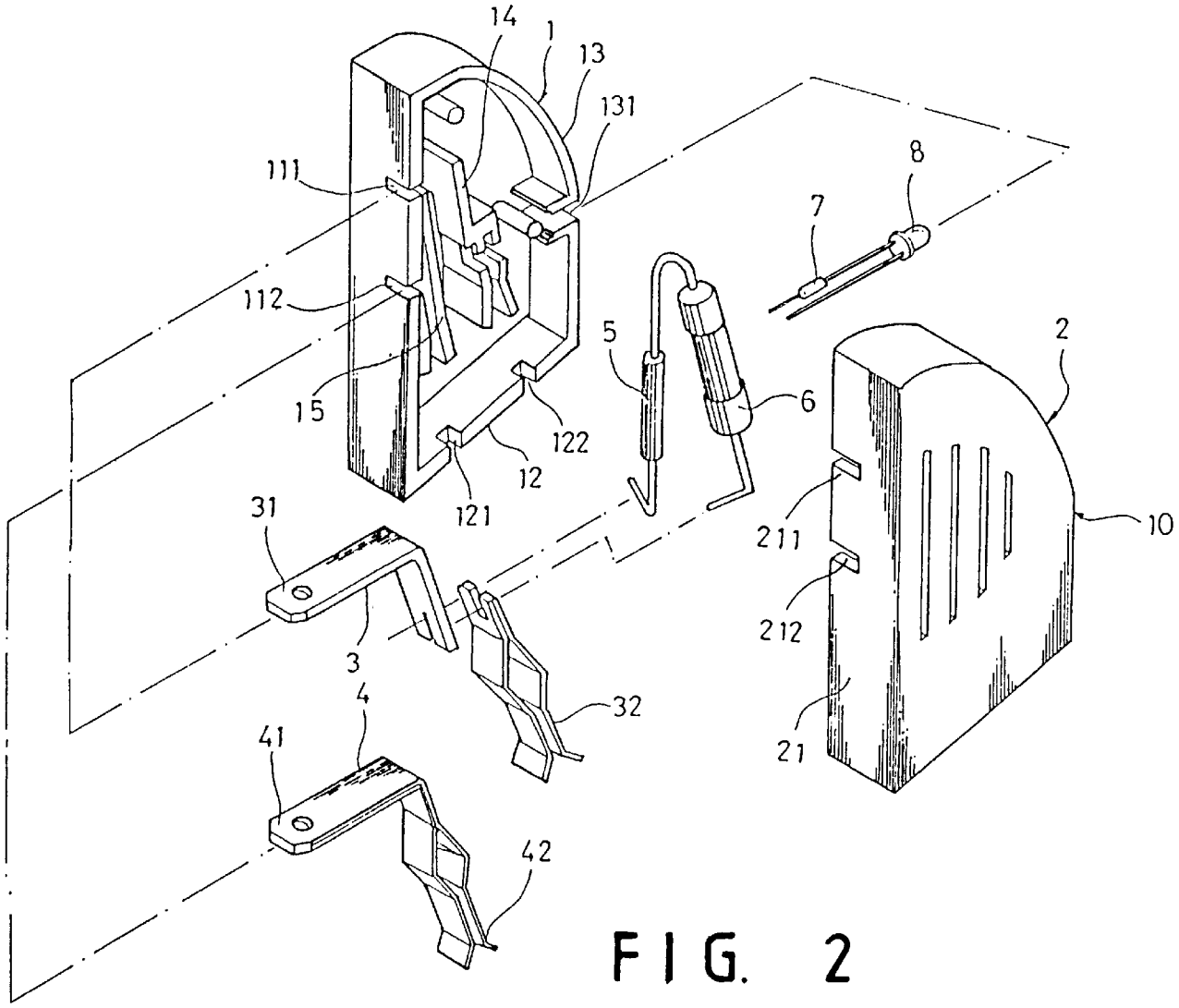
FIG. 2 is an exploded view of the safety electric adapter shown in FIG. 1.
Figure 3:
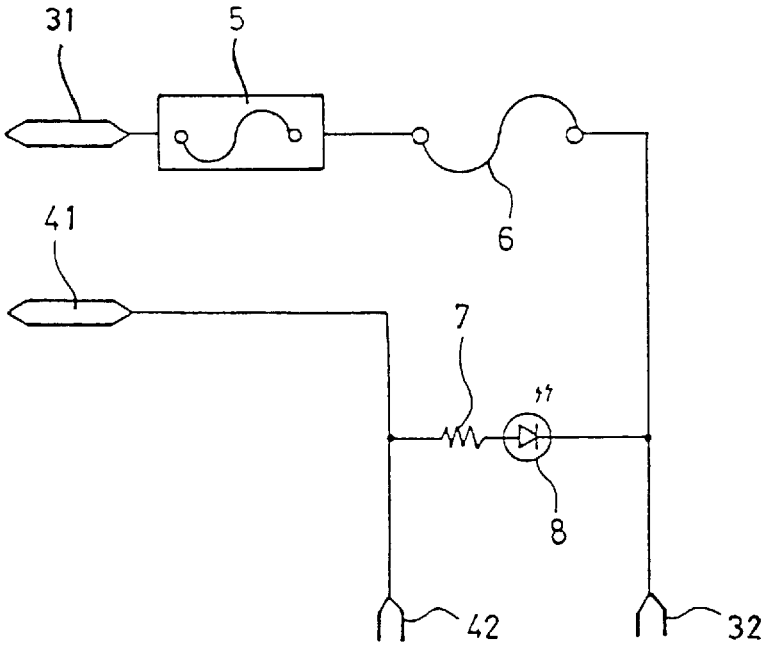
FIG. 3 is a circuit diagram of the present invention.

Referring to FIGS. 1, 2 and 3, an electric adapter in accordance with the present invention comprises an electrically insulative housing 10. The housing 10 is comprised of a left half shell 1 and a right half shell 2. The left half shell 1 comprises a first straight upright wall 11, a second straight upright wall 12 extended from one end of the first straight upright wall 11 at an angle, an arched upright wall 13 connected between the first straight upright wall 11 and the second straight upright wall 12, two elongated slots 111, 112 at the first straight upright wall 11, two plug holes 121, 122 at the second straight upright wall 12, an opening 131 at the arched upright wall 13, and a plurality of upright locating plates 14, 15 disposed on the inside. The right half shell 2 has a shape fitting over the left half shell 1, two elongated slots 211, 212 disposed at one straight upright wall 21 thereof and respectively aligned with the elongated slots 111, 112 of the left half shell 1. The right half shell 2 also has plug holes (not shown) respectively matched with the plug holes 121, 122 of the left half shell 1. Two metal blades, namely, the first metal blade 3 and the second metal blade 4 are respectively mounted in the housing 10 and retained in place by the upright locating plates 14, 15 of the left half shell 1, having a respective front plug plate 31;41 extended out of the housing 10 through the elongated slots 111, 112 of the left half shell 1 and the elongated slots 211, 212 of the right half shell 2, and a respectively forked receiving tail 32, 42 respectively disposed in alignment with the plug holes 121, 122 of the left half shell 1 and the corresponding plug holes of the right half shell 2. The forked receiving tail 32 of the first metal blade 3 is connected to the corresponding front plug plate 31 through a thermo-fuse 5 and an overcurrent protective fuse 6. The thermo-fuse 5 and the overcurrent protective fuse 6 are connected in series between the front plug plate 31 and the forked receiving tail 32. Further, a resistor 7 and a LED (light emitting diode) 8 are connected between the metal blades 3, 4. When installed, the LED 8 is received within the opening 131 of the left half shell 1. When the thermo-fuse 5 or the overcurrent protective fuse 6 is broken, the LED 8 is off.

Figure 4:
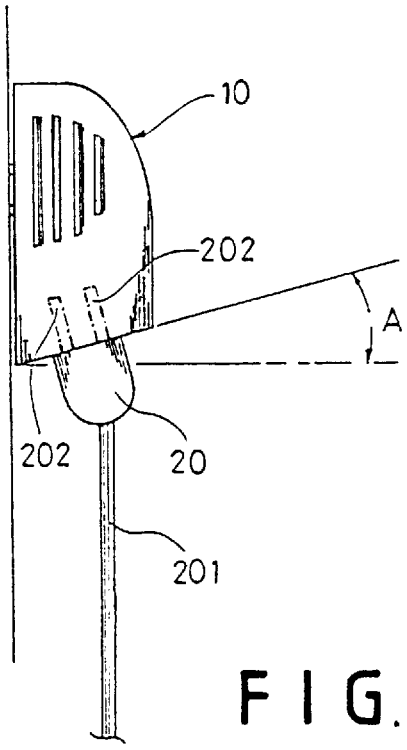
FIG. 4 is an applied view of the present invention, showing the safety electric adapter mounted in a city power supply wall outlet, an electric plug connected to the safety electric adapter.

Referring to FIG. 4 and FIG. 2 again, by means of the metal blades 3, 4, the electric adapter can be connected to a city power supply wall outlet, and an electric plug 20 of an electric appliance can then be connected to the electric adapter to receive city power supply from it. When the electric adapter is mounted in a city power supply wall outlet as shown in FIG. 4, the bottom side (the second straight upright wall 12) of the housing 10 is tilted upwards from horizontal at a sloping angle A of 16 degrees. When the electric wire 201 of the electric plug 20 is pulled downwards, a the metal blades 202 of the electric plug 20 are forced by a turning force to press against a part of the housing 10, therefore the electric plug 20 is firmly retained in place and not pulled out of the plug holes 121, 122 of the housing 10.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A safety electric adapter comprising:

an electrically insulative housing formed of two symmetrical half shells, said housing comprising a first straight side wall having a first end and a second end, a second straight side wall having a first end extended from the first end of said first straight side wall at an angle, and an arched side wall connected between the second end of said first straight side wall and a second end of said second straight side wall, a pair of blade slots at said first straight side wall, and a pair of plug holes at said second straight side wall;

a first metal blade and a second metal blade respectively mounted in said housing, said first metal blade and said second metal blade comprising a respective front plug end respectively extended out of the blade slots of said housing and adapted for mounting in a power supply outlet, and a respective forked receiving tail respectively disposed in alignment with the plug holes of said housing for receiving an electric plug being inserted into the plug holes of said housing; and a thermo-fuse and an overcurrent protective fuse connected in series between the front plug end and forked receiving tail of said first metal blade.

2. The safety electric adapter as claimed in claim 1, further comprising a resistor and a light emitting diode connected in series between said first metal blade and said second metal blade.

3. The safety electric adapter as claimed in claim 1, wherein a bottom side of said housing is tilted upwards from horizontal at a sloping angle of 16 degrees.

* * * * *